US008285167B2

(12) United States Patent
Miyazaki

(10) Patent No.: US 8,285,167 B2
(45) Date of Patent: Oct. 9, 2012

(54) FIXING DEVICE

(75) Inventor: Yasunari Miyazaki, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 436 days.

(21) Appl. No.: 12/418,727

(22) Filed: Apr. 6, 2009

(65) Prior Publication Data

US 2009/0257769 A1 Oct. 15, 2009

Related U.S. Application Data

(60) Provisional application No. 61/043,803, filed on Apr. 10, 2008.

(51) Int. Cl.
*G03G 15/20* (2006.01)

(52) U.S. Cl. ..... 399/69; 399/328; 399/329; 399/330; 399/331; 399/334

(58) Field of Classification Search ..... 399/69
See application file for complete search history.

(56) References Cited

U.S. PATENT DOCUMENTS

| | | | | |
|---|---|---|---|---|
| 2004/0222216 | A1* | 11/2004 | Kinouchi et al. | 219/619 |
| 2004/0264991 | A1* | 12/2004 | Yoshikawa | 399/69 |
| 2005/0117923 | A1* | 6/2005 | Sasamoto et al. | 399/45 |
| 2005/0199612 | A1* | 9/2005 | Kikuchi et al. | 219/619 |
| 2006/0099001 | A1* | 5/2006 | Asakura et al. | 399/69 |
| 2006/0165428 | A1* | 7/2006 | Hasegawa | 399/69 |
| 2007/0217805 | A1* | 9/2007 | Inoue et al. | 399/69 |
| 2008/0131158 | A1* | 6/2008 | Kikuchi | 399/69 |
| 2008/0260408 | A1* | 10/2008 | Takagi et al. | 399/69 |
| 2009/0226202 | A1* | 9/2009 | Kinouchi et al. | 399/69 |

FOREIGN PATENT DOCUMENTS

| | | |
|---|---|---|
| JP | 2001-318557 | 11/2001 |
| JP | 2006-195422 | 7/2006 |
| JP | 2007-280930 | 10/2007 |

* cited by examiner

*Primary Examiner* — Walter L Lindsay, Jr.
*Assistant Examiner* — David Bolduc
(74) *Attorney, Agent, or Firm* — Turocy & Watson, LLP

(57) ABSTRACT

A fixing device configured to fix a toner image on a moving printing medium includes: a fixing heat generator that generates heat by electromagnetic induction; a fixing medium that rotates and is heated while being carried by the heating medium; and a pressing member that presses a back surface of the printing medium coming into contact with the fixing medium, the fixing heat generator including a center coil and a pair of side coils provided at a center portion and both side portions thereof along a direction perpendicular to the direction of movement of the printing medium for heating the fixing medium by induction heating, the pressing member including a center heater and a side heater that heat a center portion and both side portions thereof in a direction perpendicular to the direction of movement of the printing medium integrated therein.

19 Claims, 5 Drawing Sheets

FIXING DEVICE

CROSS-REFERENCE TO RELATED APPLICATION

This application is based upon and claims the benefit of priority from prior Application No. 61/043,803, filed on Apr. 10, 2008, the entire contents of which are incorporated herein by reference.

TECHNICAL FIELD

The present invention relates to a fixing device used in an image forming apparatus of an electrophotographic system and, more specifically to a fixing device having a structure including a plurality of heaters in a press roller.

BACKGROUND

In an image forming apparatus such as an electrophotographic apparatus or the like, an electrostatic latent image is formed, and then the electrostatic latent image is developed by toner or the like, and a developed toner image is fixed to a printing sheet. In order to fix the image to the printing sheet, it is necessary to apply heat to the toner image and, normally, the fixation is achieved by heating the printing sheet having the toner image held thereon from the front surface with a fixing roller and applying a pressure from the back surface with a press roller.

For example, heating of the fixing roller is achieved by winding a fixing belt between the fixing roller and a heat roller, heating the heat roller by a heater integrated in the heat roller, transferring the heat to the fixing belt, and transferring the transferred heat to the fixing roller (for example, JP-A-2001-318557).

The printing sheet to be subjected to the fixation of the toner image includes those in various sizes, and these printing sheets have different widths. For example, when the fixation is carried out on a printing sheet having a small width, the temperature of a portion of the fixing roller which actually carries out the fixation falls. In contrast, end portions which do not carry out the fixation are kept at a raised temperature, and hence might be overheated.

In this manner, when printing an image using a small size sheet, the temperature of the portion of the fixing roller where the printing sheet passes falls because the printing sheet absorbs the heat therefrom, so that the temperature control is achieved by heating. In contrast, it is known that the portion of the fixing roller where the printing sheet does not pass is overheated because the heat is not absorbed by the sheet, so that the temperature rise is resulted.

In order to prevent the temperature rise as such, JP-A-2001-318557 discloses an image forming apparatus in which a heat source (heat lamp) for a large size sheet is turns ON for the fixation of a large size sheet, and a heat source for a small size sheet and the heat source for the large size sheet controlled to a low power are used for the fixation of the small size sheet. In this publication, there are descriptions such that the heat source for the large size sheet may be provided within the press roller instead of within the heat roller (see FIG. 9) and the fixing belt is heated from the outside by a cleaning roller (having the heat source for the large size integrated therein) which comes into contact with the fixing belt (see FIG. 6).

When heating the press roller as well, since the portion which is free from contact of the printing sheet might be overheated when the fixation of the printing sheet having a small width is carried out, it is also contemplated to prevent the temperature rise by providing a heat source for the large size sheet and a heat source for the small size sheet in the press roller.

When the heat roller or the fixing belt (heat belt) is heated by the heat source (heater) provided in the heat roller or the cleaning roller as described above, a large heat capacity is required, and hence it takes a significantly long time from the power-on of the device until the temperature of the portion of the fixing belt which comes into contact with the press roller rises to a predetermined temperature. Therefore, there is a problem such that copying cannot be started immediately after the power-on of the image forming apparatus.

In order to shorten the rising time after the power-on, a system to heat the fixing belt directly from the outside by an induction heating (IH) or the like is contemplated. According to the fixing belt direct heating system, since the heat capacity is small, the time required for heating the surface of the fixing belt to a predetermined temperature is shortened, so that the rising time after the power-on is shortened correspondingly. In contrast, since the temperature fall tends to occur in the portion of the fixing belt where the printing sheet comes into contact with, it is necessary to heat this portion, while the temperature rise tends to occur in the portion where the printing sheet does not come into contact with. Therefore, it is contemplated to use a separate induction heat device obtained by dividing the induction heat device which heats the fixing belt directly from the outside into a center portion and both side portions.

The invention relates to a fixing device having a separate induction heat unit which divides the fixing belt into sections in the widthwise direction and induction-heats the same and a multiple-heater integrated press roller having a plurality of integrated heaters to be used according to the width of the printing sheet.

Referring now to the drawings, problems of the fixing device having the structure as described above will be described.

According to the induction heat device having a divided structure, the fixing belt can be heated by selectively driving the plurality of heaters having a heating portion at positions different axially from each other according to the sheet width. However, the sheet width does not necessarily match the positions where a coil is divided, and the printing sheet might pass over part of the width of a divided induction coil. In such a case, the temperature fall occurs in the portion of the fixing belt where the printing sheet passes, while the temperature fall does not occur where the printing sheet does not pass, and hence partial overheating or temperature fall cannot be avoided if the belt is uniformly heated.

FIG. 1 shows a state where the printing sheet passes over part of divided induction heat coils as described above. It is assumed that an induction heat coil 13 includes a center coil 13*a*, and side coils 13*b* and 13*c* provided on both sides thereof with respect to a fixing belt 12, and temperature sensors 15*a*, 15*b*, and 15*c* sense passage of the printing sheet with respect to the center coil 13*a* and the side coils 13*b* and 13*c*. In this case, as shown in the drawing, when a printing sheet P1 having a width W1 passes, that is, the printing sheet passes so that the side edges thereof match the divided positions of the divided coils, the temperature sensor 15*a* senses the passage of the printing sheet, and the temperature sensors 15*b* and 15*c* do not sense the passage of the printing sheet. Therefore, only the center coil 13*a* is energized, and hence only the center portion of the fixing belt is heated, so that an adequate temperature control is achieved. However, when a printing sheet P2 having a width W2 passes the induction heat device, the passage of the printing sheet is sensed or not sensed depending on the positions where the temperature sensors 15*b* and 15*c* are installed. For example, it is assumed that the temperature sensor 15*b* is provided at the center of the side coil 13*b* and the temperature sensor 15*c* is provided on the outer end of the side coil 13*c* as shown in FIG. 1. In this case, since the temperature sensor 15*c* is provided at the end, the temperature fall is not sensed even though the printing sheet P2 passes and the side coil 13*c* is not heated. In contrast, since the temperature sensor 15*b* is provided at the substantially center of the side coil 13*b*, the temperature sensor 15*b* senses the temperature fall due to the printing sheet P2 and the passage of the printing sheet is sensed, so that the side coil 13*b* is heated. However, since the printing sheet does not pass a portion outside the center of the side coil 13*b*, the temperature does not fall, and hence the overheated state is resulted.

In particular, when heating directly from the outside of the fixing belt by an electromagnetic induction heating, the fixing belt (heat belt) as a heating object have a low heat capacity in many cases. Therefore, if the heating by the respective divided side coils continues, the temperature of the non-sheet-passing portion of the fixing belt might rise. Also, if an attempt is made to restrain the temperature rise of the non-sheet-passing portion by lowering the temperature of the side end portion of the fixing belt to be induction heated, the temperature rise in the non-sheet-passing both end portions is restrained, but the temperature of the fixing belt in the inner end of the side coils (the end portions of the side coils 13*b* and 13*c* near the center coil 13*a* in FIG. 1) is also lowered. Therefore, the temperature of the portions of the fixing belt in the widthwise direction corresponding to the side coils 13*b* and 13*c* where the printing sheet passes falls, there is a problem such that the defective fixation in these portions or the defective image quality such that the gloss of the printed image is fluctuated might occur in a portion corresponding to the center coil and portions of the side coils near the center coil.

The invention provides a fixing device which solves the problems of the fixing device of a separate induction heat type using a fixing belt or a fixing roller in the related art.

SUMMARY

According to a first aspect of the invention, there is provided a fixing device configured to fix a toner image on a moving printing medium and including: a fixing heat generator that generates heat by electromagnetic induction; a fixing medium that rotates and is heated while being carried by the heating medium; and a pressing member that comes into press contact with a back surface of the printing medium which is brought into contact with the fixing medium, the fixing heat generator including a center coil and a pair of side coils provided at a center portion and both side portions thereof in terms of a vertical direction with respect to the direction of movement of the printing medium for heating the fixing medium by induction heating, the pressing member including a center heater and a side heater that heat the center portion and the both side portions thereof in the vertical direction in terms of the direction of movement of the printing medium respectively integrated therein, a side temperature sensor that senses at least one of the temperatures of the both side portions in terms of a widthwise direction vertical to the direction of movement of the printing medium, and a heater control unit that turns OFF the side heater if the temperature that the side temperature sensor senses exceeds a predetermined temperature.

DETAILED DESCRIPTION

Figure 1:
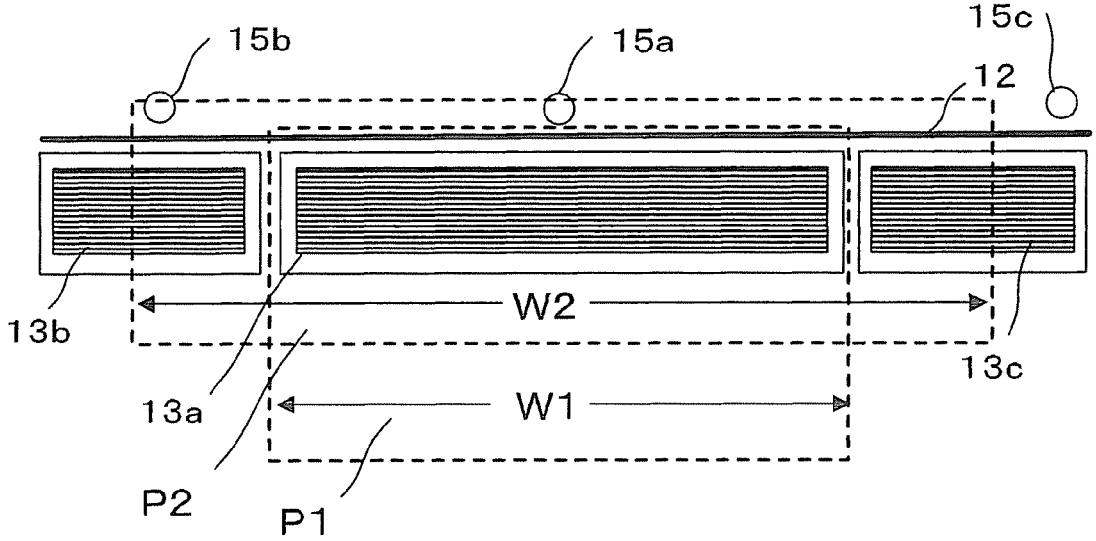
FIG. 1 is a drawing for explaining a problem of a fixing device in the related art.

Referring now to the drawings, an embodiment of an image forming apparatus according to the invention will be described. The invention is applied to a case of heating a fixing belt and a fixing roller by an electromagnetic induction heating (IH) using divided coils, and is specifically effective for a fixing device in which the fixing belt and the fixing roller is directly heated from the outside.

Figure 2:
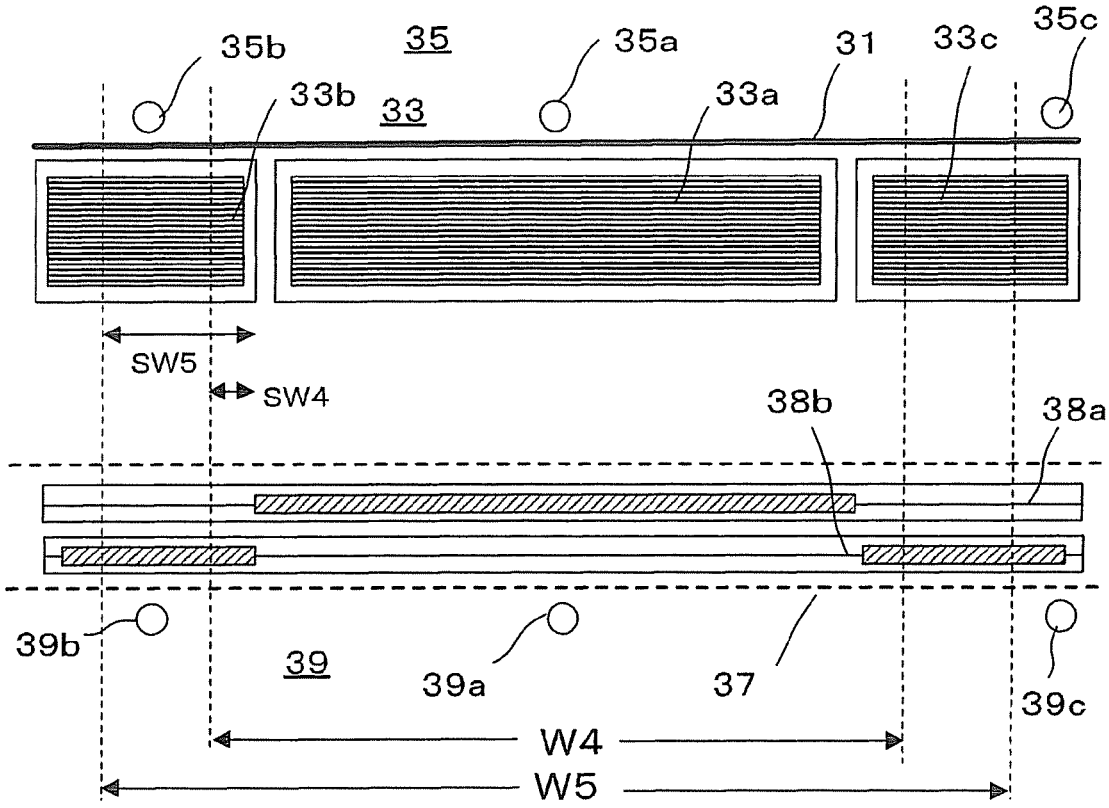
FIG. 2 is a drawing showing a relation between an induction heat device and a press roller in an embodiment of the invention.
Figure 3:
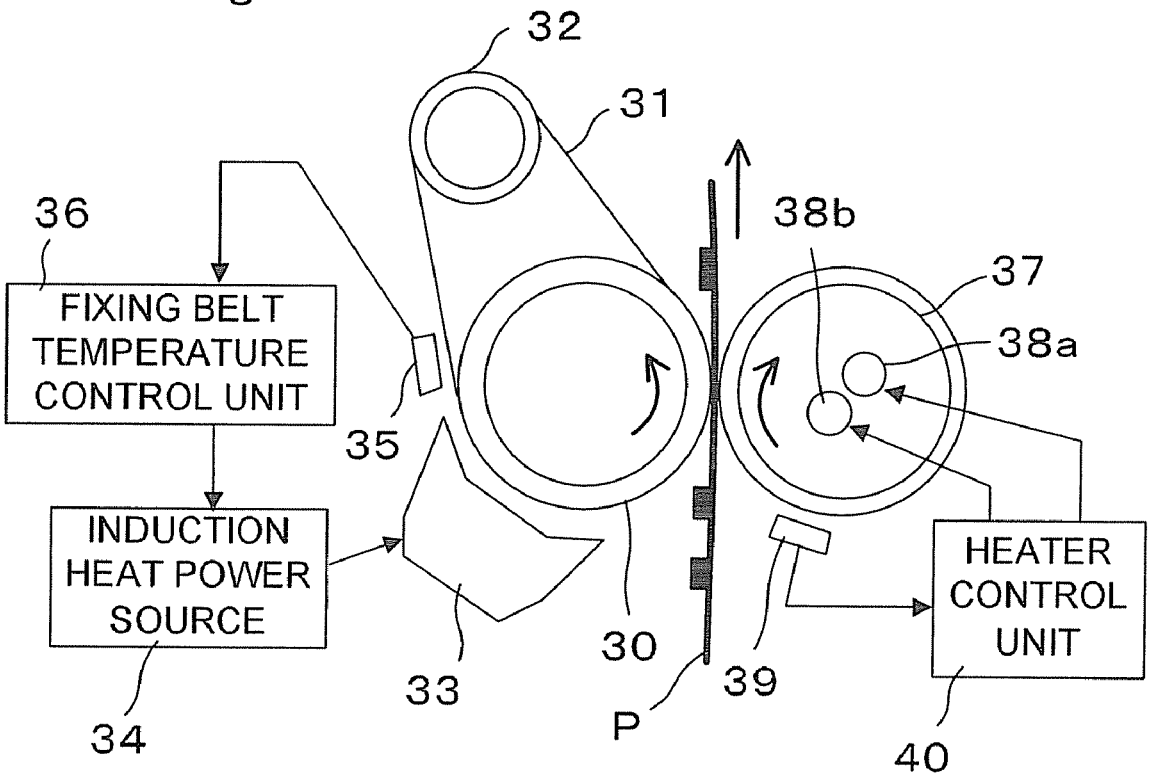
FIG. 3 is a cross-sectional view showing a structure of the fixing device according to the embodiment of the invention.

Referring now to FIG. 2 and FIG. 3, a configuration of the fixing device according to the embodiment of the invention will be described. FIG. 3 is a cross-sectional view showing the structure of the fixing device.

The fixing device includes a fixing roller 30, a band-shaped fixing belt 31 wound around the fixing roller 30 and heated, a tension roller 32 around which the fixing belt 31 is wound for providing a tension to the belt, an induction heat coil 33 that heats the fixing belt 31 directly from the outside by the electromagnetic induction heating, an induction heat power source 34 that supplies a power to the induction heat coil 33, a fixing belt temperature sensor 35 that senses the surface temperature of the fixing belt 31, a fixing belt temperature control unit 36 that controls the induction heat power source 34 for controlling the temperature of an outer surface of the fixing belt according to the temperature sensed by the fixing belt temperature sensor 35, a press roller 37 provided so as to oppose the fixing roller 30 on which the fixing belt 31 is wound and brought into press contact with a printing sheet P from the back side thereof, a center heater 38*a* and a side heater 38*b* integrated in the press roller 37, a press roller temperature sensor 39 that senses the temperatures of the outer surfaces of the press roller 37, and a heater control unit 40 that controls the passage of electric current through the center heater 38*a* and the side heater 38*b* on the basis of the temperature that the press roller temperature sensor 39 senses.

FIG. 2 shows a relation between the structure of the induction heat coil 33 and the fixing belt temperature sensor 35, and a relation between the press roller 37 and the press roller temperature sensor 39. As shown in FIG. 2, the induction heat coil 33 is divided into three parts in the axial direction and includes one center coil 33*a* and two side coils 33*b* and 33*c* disposed on both sides thereof. Part or the entire portion of the coils are driven according to the size of the printing sheet, and the fixing belt 31 is heated in the widthwise direction correspondingly.

The induction heat coil 33 is divided into the center coil 33*a* that heats the center and side coils 33*b* and 33*c* that heat the sides, and the fixing belt 31 is electromagnetic induction heated by the divided center coil 33*a* and the side coils 33*b* and 33*c*. The center coil 33*a* and the side coils 33*b* and 33*c* are alternately and repeatedly driven to perform the electromagnetic induction heating, and repeat heating continuously.

The fixing belt temperature sensor 35 includes a fixing belt center temperature sensor 35*a* provided at a position corresponding to the center of the center coil 33*a* of the fixing belt 31, a fixing belt side temperature sensor 35*b* provided at a position corresponding to the center of the side coil 33*b*, and a fixing belt abnormal temperature sensor 35*c* provided near the outer end of the side coil 33*c* for sensing abnormality.

The press roller 37 which is opposed to the fixing belt 31 and is to be brought into press contact therewith includes the center heater 38*a* having a heating portion that mainly heats the axially center portion of the surface thereof, and the side heater 38*b* having a heating portion that mainly heats both end portions integrated therein. The heating portion of the center heater 38*a* corresponds to the center coil 33*a* of the induction heat coil 33, and the heating portions of the side heater 38*b* correspond to the side coils 33*b* and 33*c* of the induction heat coil 33.

The press roller temperature sensor 39 that senses the surface temperature of the press roller 37 includes a press roller center temperature sensor 39*a* provided near the center of the press roller for sensing the temperature of the center portion thereof, a press roller side temperature sensor 39*b* provided near the center of one of the heating portions of the side heater 38*b*, and a press roller abnormal temperature sensor 39*c* provided near an end of the other heating portion of the side heater 38*b*.

The surface temperature sensed axially of the press roller 37 by the press roller center temperature sensor 39*a* and the press roller side temperature sensor 39*b* is inputted to the heater control unit 40, and the heater control unit 40 selectively passes electric current through the center heater 38*a* and the side heater 38*b* correspondingly. In other words, if only the press roller center temperature sensor 39*a* senses the temperature fall of the surface of the press roller 37, the heater control unit 40 passes electric current through the center heater 38*a*, and if the press roller center temperature sensor 39*a* and the press roller side temperature sensor 39*b* sense the temperature fall of the surface of the press roller 37, the heater control unit 40 passes electric current through the center heater 38*a* and the side heater 38*b*.

The fixing belt center temperature sensor 35*a*, the fixing belt side temperature sensor 35*b*, the fixing belt abnormal temperature sensor 35*c*, the press roller center temperature sensor 39*a*, the press roller side temperature sensor 39*b*, and the press roller abnormal temperature sensor 39*c* are configured of a thermistor or a thermopile. The fixing belt abnormal temperature sensor 35*c* and the press roller abnormal temperature sensor 39*c* are temperature sensors for sensing abnormal heating of the side portions of the side coil 33*c* and the side heater 38*b*.

The fixing belt center temperature sensor 35*a* and the press roller center temperature sensor 39*a* sense the temperature change (rise and fall) caused by the passage of sheets in the center portions of the center coil 33*a* and the press roller 37. The fixing belt side temperature sensor 35*b* and the press roller side temperature sensor 39*b* sense the temperature change due to the passage of sheets in the side end portions of the side coil 33*b* and the press roller.

The temperature fall which occurs when the printing sheet passes may be sensed on one of the IH coil side or the press roller side. Therefore, if the press roller center temperature sensor 39*a* and the press roller side temperature sensor 39*b* are provided, the fixing belt center temperature sensor 35*a* and the fixing belt side temperature sensor 35*b* are not necessarily required. Since the center coil 33*a* and the side coils 33*b* and 33*c* achieve significant thermal fluctuations since they are adapted to heat by AC current passed therethrough, and the temperature sensors 39*a* and 39*b* on the side of the press roller exhibit less abrupt fluctuations in sensed temperatures than the temperature sensors 35*a* and 35*b* on the side of the IH coil, so that the stable temperature detection is advantageously ensured. Description of this embodiment will be given below under the assumption that the temperature is sensed by the temperature sensors 39*a* and 39*b* on the side of the press roller.

It is assumed that the induction heat coil 33 is induction-heated by an alternate drive system which drives the center coil 33*a* and the side coils 33*b* and 33*c* alternately.

Referring now to a flowchart shown in FIG. 4, an operation of this embodiment of the invention will be described on the basis of the width of the printing sheet separately for (A) the case of a sheet width W4 and (B) the case of a sheet width W5 shown in FIG. 2. (A) The case of sheet width W4 shown in FIG. 2

Figure 5:
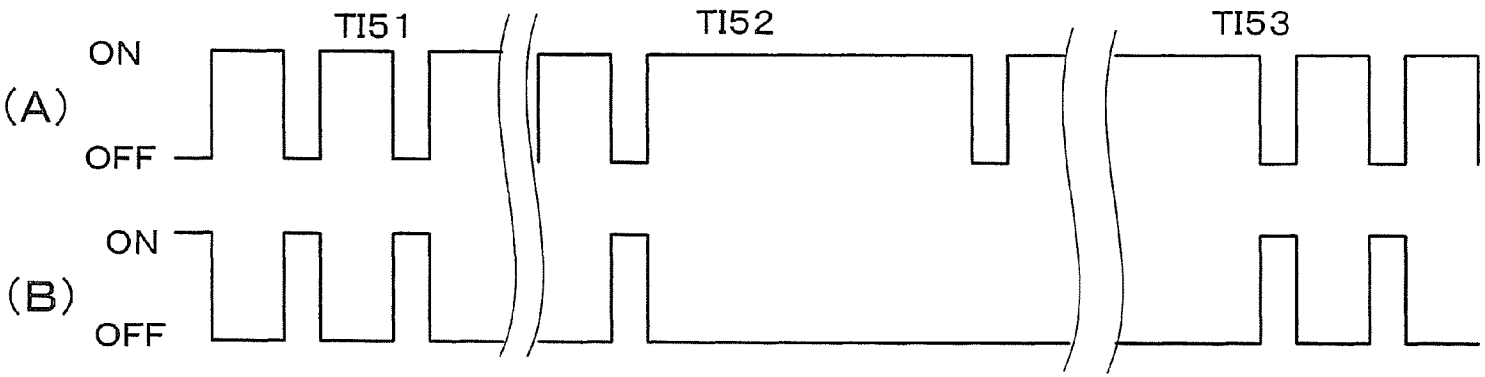
FIG. 5 is a drawing showing the timing of the passage of electric current through a heater integrated in the press roller according to the embodiment of the invention.

FIG. 5 shows a state in which the center heater 38*a* in the press roller 37 is heated (part (A)) and a state in which the side heater 38*b* is heated (part (B)). In other words, as is clear from the FIG. 2, the part (A) in FIG. 5 shows the case where the center portion of the press roller 37 is heated and the part (B) in FIG. 5 shows the case where the both side portions of the press roller 37 are heated.

A time TI51 in the parts (A) and (B) in FIG. 5 shows a state in which the press roller 37 is heated to a constant temperature. The reason why the timing of the passage of electric current is opposite between the center heater 38*a* and the side heater 38*b* (ON state and OFF state appear at opposite timings) is because the alternate drive system is employed. By employing the alternate drive system, high-power lamps may be used in the center portion and the side portion. In other words, there is a limit in available power. For example, assuming that the available power is 300 W, if the center portion and the side portion are turned ON simultaneously, only the lamps of 150 W maximum each can be used in a simultaneous drive system. In contrast, by employing the alternate drive system, the high-power lamps of 300 W may be used respectively in the center portion and the side portion.

Figure 6:
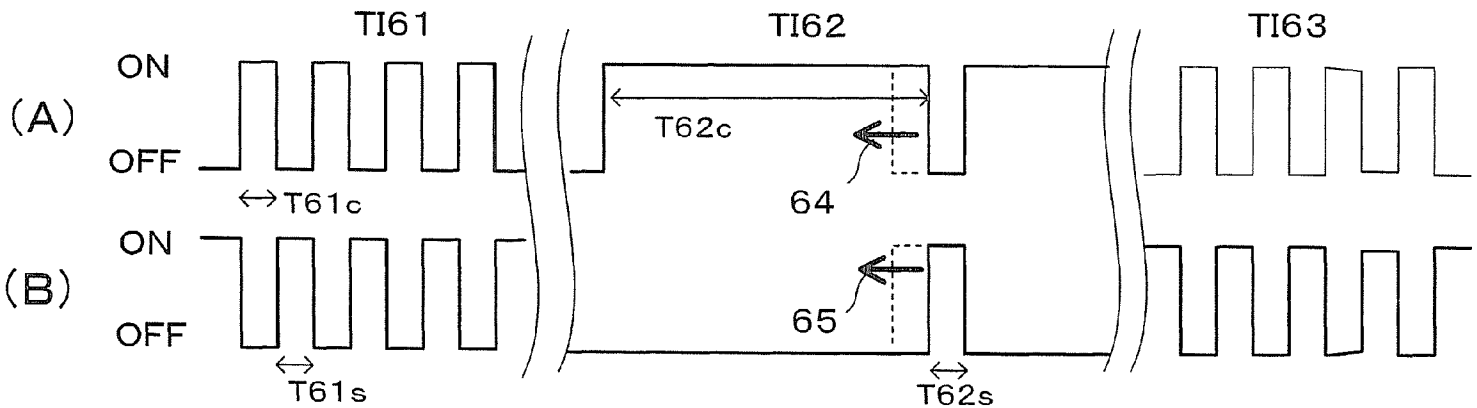
FIG. 6 is a drawing showing the timing of the passage of electric current through a coil of an induction heat device according to the embodiment of the invention.

FIG. 6 shows the timing of the passage of electric current through the center coil 33*a* (part (A)), and the timing of the passage of electric current through the side coils 33*b* and 33*c* (part (B)). In other words, the center coil and the side coil are driven alternately. The side coil 33*b* and the side coil 33*c* are handled completely in the same manner, and are passed with the electric current therethrough at the same timing. A time TI61 shows a case of maintaining the constant temperature. In the case of the alternate drive system, since the center coil 33*a* and the side coils 33*b* and 33*c* are driven alternately, the center portion and the side portion of the fixing belt 31 are heated alternately.

As the percentage of heating between the center portion and the side portion of the fixing belt 31, the periods of the passage of electric current through the center coil 33*a* and the side coils 33*b* and 33*c* are changed according to a duty ratio, and an optimal duty ratio is selected. Therefore, in the time TI61 in which the predetermined temperature is maintained, a current-passing time T61*c* through the center coil 33*a* (turned ON) and a time T61*s* in which electric current is passed through the side coils 33*b* and 33*c* are the same, and the duty ratio of the passage of electric current is T61*c*/(T61*c*+T61*s*), which is 50 percent.

Figure 4:
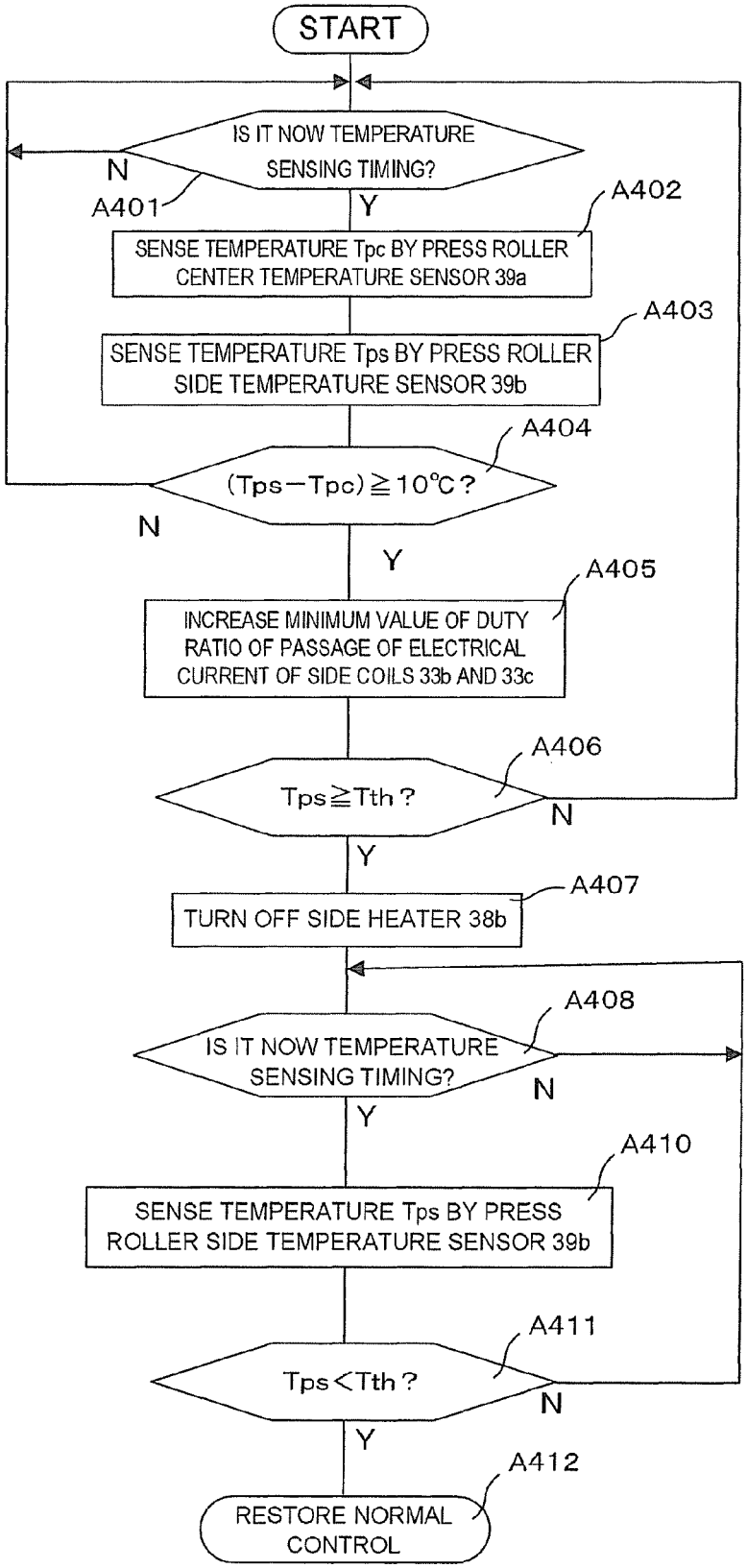
FIG. 4 is a drawing for explaining an operation of the fixing device according to the embodiment of the invention.

In FIG. 4, the press roller center temperature sensor 39*a* and the press roller side temperature sensor 39*b* sense (measure) the temperature of the surface of the press roller 37 at a predetermined temporal intervals (timing). In Act A401, whether there comes such the temperature sensing timing or not is sensed. If there comes the temperature sensing timing, the press roller center temperature sensor 39*a* senses a temperature Tpc of the surface of the press roller 37 in Act A402.

Subsequently, in Act A403, the press roller side temperature sensor 39*b* senses a temperature Tps of the surface of the press roller 37. The sensed temperature Tpc and Tps are inputted to the heater control unit 40. In Act A404, the heater control unit 40 obtains a temperature difference ΔTp between the sensed temperature Tps and the sensed temperature Tpc.

$$Tps-Tpc=\Delta Tp$$

Then, in Act A404, the heater control unit 40 determines whether the temperature difference ΔTp is 10° C. or higher.

There, the reason to inspect the temperature difference between the press roller center temperature sensor 39*a* and the press roller side temperature sensor 39*b* will be described. In the case (A), since the side end of the printing sheet is positioned inside the press roller side temperature sensor 39*b*, the press roller side temperature sensor 39*b* which is located outside thereof cannot sense the temperature fall at the time of the passage of the printing sheet accurately, so that the press roller 37 is increased in temperature to a relatively high temperature. In contrast, since the printing sheet comes into contact with the portion of the press roller that the press roller center temperature sensor 39*a* senses, the temperature does not rise, and hence continuous heating is necessary.

In Act A404, if the temperature difference ΔTp=(Tps−Tpc) is 10° C. or higher, the procedure goes to Act A405, where the minimum value of the duty ratio of the passage of electrical current between the side coils 33*b* and 33*c* is, for example, increased.

When the printing sheet having a width wider than that of the center coil 33*a* and narrower than that of the center position of the side coil 33*b* (W4) is passed continuously, the printing sheets absorb heat from the area of the fixing belt 31 where the sheets pass. Therefore, in the longitudinal direction of the fixing belt 31, the temperature falls and is brought into a state of being controlled in temperature. In contrast, in the area where the printing sheets do not pass, heat supply to the printing sheets is not carried out, and hence the temperature rises due to the excessive heat.

The center coil 33*a* and the side coils 33*b* and 33*c* are driven alternately, and the induction heating is carried out constantly by passing electric current through either one of the center coil 33*a* and the side coils 33*b* and 33*c*, so that the area of the fixing belt 31 where the sheets do not pass is also heated constantly.

If the passage of electrical current through the side coils 33*b* and 33*c* is cut, the temperature of the areas of the side coils 33*b* and 33*c* where the sheets pass (SW4) also falls, so that heating of the side coils is necessary.

When the drive system of the induction heat coil is the simultaneous drive system, since the temperature maintenance in the side heating areas of the fixing belt 31 where the sheets pass is difficult if the passage of electrical current through the side coils is cut, heating is necessary.

When the width of the printing sheet is W4 in FIG. 2, since the press roller side temperature sensor 39*b* is positioned out of the area where the sheet pass, it is determined that the heat is not absorbed by the passage of the printing sheet, whereby the temperature is controlled to be maintained or to be lowered. Actually, however, parts SW4 of the side coils 33*b* and 33*c* are included in an area where the sheets pass, the temperature in this area falls and hence a state of requiring heat supply to enable the fixation of the toner image is resulted.

In this case, when the sheets are passed continuously, a duty ratio is selected so as to maintain the temperature for the center portion of the fixing belt 31, and keep the temperature in the area where the sheets pass within a range in which the offset does not occur and hence the defective image is not made and the temperature rise is minimized in the non-sheet-passing portion for the side portions.

However, in order to maintain the temperature of the areas in the side portions of the fixing belt 31 where the sheets pass within the range in which the offset does not occur and hence the defective image is not made, it is necessary to heat the side portions of the fixing belt 31 by distributing the duty ratio to the side coils 33*b* and 33*c* at a ratio larger than a certain level. In this manner, if electric current is passed through the side coils 33*b* and 33*c* so as to heat the area where the sheets pass, the areas of the side portions of the fixing belt 31 where the sheets do not pass is brought into an excessively heated state, whereby the temperature rise might occur.

In this manner, while the temperature is controlled in the center portion of the fixing belt 31 so as to prevent the temperature fall due to the passage of the sheets, the press roller side temperature sensor 39*b* does not sense the temperature fall due to the passage of the sheets in the side portions and hence the temperature rises continuously. Therefore, the difference between the temperature Tps that the press roller side temperature sensor 39*b* senses and the temperature Tpc that the press roller center temperature sensor 39*a* senses is increased.

The reason why the threshold temperature as a criterion of the temperature difference is set to 10° C. is because the erroneous control may be resulted due to the temperature fluctuations such as temperature ripples or the control temperature unit if it is lower than 10° C.

It is also possible to set the threshold temperature as the criterion of the temperature difference ΔTp is a value lower than 10° C. depending on the degree of uniformization of the temperature ripple or the temperature fluctuation in the longitudinal direction, and might be set to 10° C. or higher depending on the environment.

If Tps−Tpc is lower than 10° C. in the next Act A404, the procedure goes back to Act A401, where the next timing of the temperature sensing is waited.

If the fixation to the printing sheets is continuously carried out, the sensed temperature Tpc in the center portion of the press roller 37 is lowered, and the sensed temperature Tps outside the side portions of the press roller 37 rises, so that the temperature difference ΔTp between these temperatures is gradually increased. In contrast, the temperature inside the side portions of the press roller 37 falls.

Therefore, if the temperature difference ΔTp reaches or exceeds 10° C. in Act A404, the minimum value of the duty ratio of the passage of electric current through the side coils 33*b* and 33*c* is heightened to increase the temperature in Act A405. This will be described on the basis of the timing chart of a time TI62 in FIG. 6. The current-passing time of the center coil 33*a* at this time is T62*c* and the current-passing time of the side coils 33*b* and 33*c* is T62*s*. Therefore, the duty ratio of the passage of electrical current through the side coils 33*b* and 33*c* is T62*s*/(T62*c*+T62*s*). For example, T62*c*=180 msec, and T62*s*=20 msec. The duty ratio of the passage of electrical current through the side coils 33*b* and 33*c* at this time is 10%.

In this state, if the ΔTp reaches or exceeds 10° C., for example, the current-passing time through the center coil and the side coils are controlled to achieve, for example, T62*c*=160 msec and T62*s*=40 msec. The duty ratio of the passage of electrical current through the side coils 33*b* and 33*c* at this time is T62*s*/(T62*c*+T62*s*)=20%. In other words, the temperature fall in the portion SW4 in FIG. 2 is prevented by increasing supply of electric power to the side coils 33*b* and 33*c* and reducing the supply of electric power to the center coil 33*a*.

In the time TI62 in FIG. 6, as indicated by arrows 64 and 65, the current-passing time to the center coil 33*a* is reduced and the current-passing time to the side coils 33*b* and 33*c* is increased. It means that the temperature fall is resulted since the printing sheet passes through the SW4 in FIG. 2, so that the side coils are further heated in order to rise the temperature of this portion. However, since a feedback control is carried out on the basis of the sensed temperature, the overheated state is not resulted.

Although not shown in the drawing, the heater control unit 40 includes a duty ratio control unit that prevents the temperature fall due to the printing sheet passing through the inside the side temperature sensor by increasing the duty ratio of the passage of electrical current through the side coils 33*b* and 33*c* if the temperature difference (Tps−Tpc) is a predetermined temperature difference or more as a result of subtracting the temperature Tpc sensed by the center temperature sensor from the temperature Tps sensed by the side temperature sensor. There is also a method of keeping at a constant temperature in Act A405.

Since the temperature Tps that the press roller side temperature sensor 39*b* senses rises in this manner, in the next Act A406, the heater control unit 40 shown in FIG. 3 determines whether the sensed temperature Tps is equal to or higher than a predetermined temperature Tth or not. When the sensed temperature Tps is lower than the predetermined temperature Tth, the procedure goes back to Act A401, where the next timing of temperature sensing is waited.

"When the sensed temperature Tps is lower than the predetermined temperature Tth" means that the side portions of the fixing belt 31 is not heated to an excessively high temperature. In contrast, if the temperature Tps that the press roller side temperature sensor 39*b* senses is the predetermined temperature Tth or higher, it means that the temperature of the side portions of the fixing belt 31 is excessively high.

If it is sensed that the sensed temperature Tps reaches or exceeds the predetermined temperature Tth, the side heater 38*b* is turned OFF in the next Act A407. Then, in the Act A408, the next timing of temperature sensing is waited.

When the next timing of temperature sensing arrives, in the next Act A410, the press roller side temperature sensor 39*b* senses the temperature Tps of the surface of the side portion of the press roller 37 as in Act A403 before.

Then, in the next Act A411, whether or not the sensed temperature Tps is lowered to a temperature lower than the predetermined temperature Tth is determined. If the sensed temperature Tps is still equal to or higher than the predetermined temperature Tth, the side heater 38*b* is kept in OFF and the procedure goes back to Act A408, where the next timing of sensing is waited. If the Tps is lowered to a temperature lower than the predetermined temperature Tth, the operation is restored to the normal control in Act A412. The predetermined temperature Tth is normally set to a temperature higher than the temperature Tpc that the press roller center temperature sensor 39*a* senses. (B) The case of printing sheet width W5 in FIG. 2

In this case, since the printing sheet extends to the outside the press roller side temperature sensor 39*b*, the press roller side temperature sensor 39*b* is able to sense the temperature fall when the printing sheet passes.

In the case of the alternate drive system, since the center coil 33*a* and the side coils 33*b* and 33*c* are driven alternately, the center portion and the side portions of the fixing belt 31 are heated alternately. As the percentage of heating between the center portions and the side portion of the fixing belt 31, the periods of the passage of electric current through the center coil 33*a* and the side coils 33*b* and 33*c* are changed according to the duty ratio, and an optimal duty ratio is selected.

In the case of the induction heating system from the outside, the heated portion of the fixing belt 31 to be heated by the electromagnetic induction cope with a rapid heating, and hence has a small heat capacity. Therefore, if the passage of electrical current of the induction heating is cut, the temperature falls abruptly, and if the passage of electrical current is started again, the temperature rises abruptly, whereby significant temperature ripples are resulted. In the induction heating, as many as several seconds of time lag occurs from the start of the passage of electrical current until a predetermined output is reached. Therefore, in view of maintaining the temperature at a constant level, it is preferable to maintain the passage of electrical current and avoid the passage of electrical current from stopping as much as possible. It is also the reason of not stopping the passage of electrical current through the side coils in this embodiment of the invention.

If the fact that the timing to sense the temperature arrives is detected in Act A401, the press roller center temperature sensor 39*a* senses the temperature of the center portion of the press roller 37 in Act A402 and the sensed temperature Tpc is obtained as described above in (A). In the subsequent Act A403, the press roller side temperature sensor 39*b* senses the temperature of the side portion of the press roller 37, and the sensed temperature Tps is obtained. In Act A404, whether the difference between the both sensed temperatures (Tps−Tpc)=ΔTp is 10° C. or higher is determined.

If the width of the printing sheet corresponds to W5, the difference between the sensed temperature Tpc that the press roller center temperature sensor 39*a* senses and the sensed temperature Tps sensed by the press roller side temperature sensor 39*b* is normally small, and does not reach or exceed 10° C. Therefore, the procedure goes to Act A406, where the heater control unit 40 shown in FIG. 3 determines whether the sensed temperature Tps that the press roller side temperature sensor 39*b* senses reaches or exceeds the predetermined temperature Tth. When the sensed temperature Tps is lower than the predetermined temperature Tth, the procedure goes back to Act A401, where the next timing of temperature sensing is waited.

If the sensed temperature Tps reaches or exceeds the predetermined temperature Tth, the procedure goes from Act A406 to Act A407, where the side heater 38*b* is turned OFF. The side heater 38*b* has a function to heat the side portions of the press roller 37 as shown in FIG. 2. Therefore, the sensed temperature Tps that the press roller side temperature sensor 39*b* senses should be lowered. After the side heater 38*b* is turned OFF, the procedure goes to Act A408, where the next timing of temperature sensing is waited. In Act A410, the press roller side temperature sensor 39*b* senses the temperature of the side portion of the press roller 37 as described above, and in Act A411, whether or not the sensed temperature Tps is lowered to a temperature lower than the predetermined temperature Tth. If no, the next timing of sensing is waited in the state in which the side heater 38*b* is turned OFF.

In Act A411, if the sensed temperature Tps is lowered to a temperature lower than the predetermined temperature Tth, the normal temperature control is restored.

In Act A407, the side heater 38*b* is turned OFF. However, it is to be noted that the side coils 33*b* and 33*c* of the induction heat coil 33 are driven as in the normal state. As described above, the heat capacity of the induction heat coil 33 is small. Therefore, if the passage of electrical current through the side coils 33*b* and 33*c* of the induction heat coil 33 is stopped or reduced, the temperature of the side portions of the transfer belt falls abruptly, and if the side portions of the transfer belt is heated for compensating the temperature fall, the temperature thereof rises abruptly this time, so that abrupt temperature variations are resulted. In contrast, the heat capacity of the press roller 37 is relatively large. Therefore, even though the heating of the side portions of the press roller 37 is stopped temporarily, the temperature falls gradually. This is the reason why turning OFF the side heater 38*b* without stopping the driving of the side coils 33*b* and 33*c* is preferable.

While the side heater 38*b* on the side of the press roller 37 is turned OFF, heating of the side coil on the side of the fixing belt 31 is continued, and the temperature of the entire fixing belt 31 is kept uniformly, so that the disadvantages such as partially defective fixation of images or uneven gloss of the image between the center portion and the side portions are prevented. Even when the temperature of the sheet passing portion SW5 of the fixing belt 31 is lowered when the side heater 38*b* on the side of the press roller 37 is turned OFF, the duty ratio of the passage of electrical current through the center coil 33*a* and the side coils 33*b* and 33*c* is changed, so that the temperature fall in the side portions of the fixing belt 31 is prevented. Accordingly, maintenance of the temperature in the sheet passing portion is enabled while lowering the temperature of the non-sheet-passing portion of the fixing belt 31, which is specifically effective for the alternate driving in the separated induction heating system.

While the side heater 38*b* on the side of the press roller 37 is turned OFF, heating of the side portions on the side of the fixing belt 31 is continued, and the temperature of the entire fixing belt 31 is kept uniformly, so that the disadvantages such as partially defective fixation of images or uneven gloss of the image between the center portion and the side portions are prevented.

Also, when the induction heating employs the simultaneous drive system, the passage of electrical current is maintained as in the case of the alternate drive since the side portions of the fixing belt 31 need to be heated while the sheet is passing, so that the same control as described above may be applied.

Other Embodiment

In the embodiment described above, the duty ratio of the passage of electrical current through the side coils 33*b* and 33*c* is changed when the difference between the temperature Tpc that the press roller center temperature sensor 39*a* senses and the temperature Tps that the press roller side temperature sensor 39*b* senses reaches or exceeds the predetermined temperature difference (10° C.), and the side heater 38*b* is turned OFF if the temperature Tps that the press roller side temperature sensor 39*b* senses is equal to or higher than the predetermined temperature Tth only when the temperature difference is within the predetermined temperature difference. However, it is also applicable to turn the side heater 38*b* OFF when the sensed temperature Tps is equal to or higher than the predetermined temperature without obtaining the temperature difference between the sensed temperatures Tpc and Tps.

Figure 7:
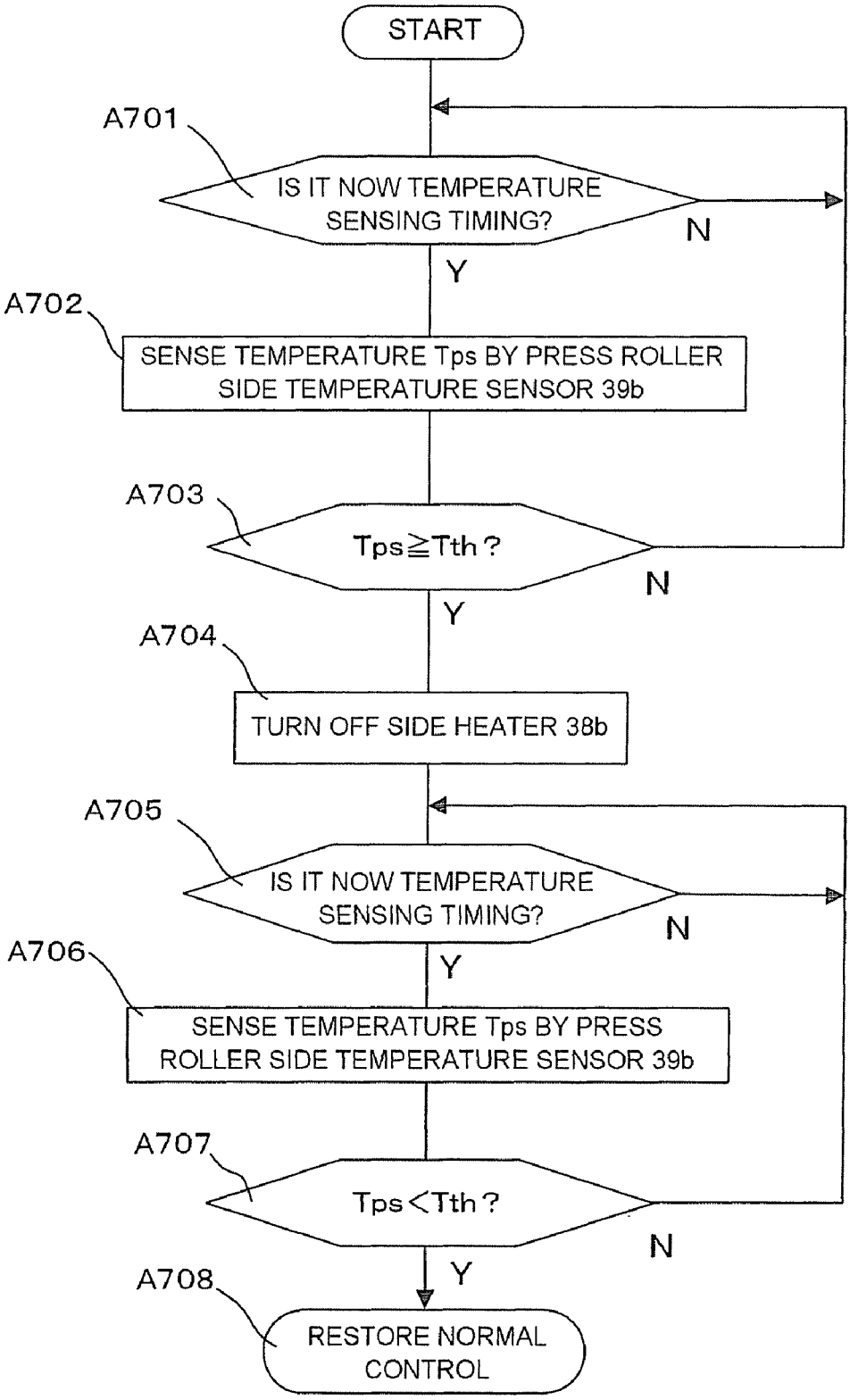
FIG. 7 is a drawing for explaining an operation of another embodiment of the invention.

Referring now to a flowchart in FIG. 7, an operation of another embodiment as described above will be described. The configuration of the fixing device in this embodiment is the same as that in the embodiment descried above, and is shown in FIG. 2 and FIG. 3.

In Act A701, whether there comes the temperature sensing timing on the basis of the predetermined time at regular intervals is determined. If there comes the sensing timing, the press roller side temperature sensor 39*b* senses the temperature of the side portion of the fixing belt 31 in Act A702. It is assumed that the temperature sensed at this time is Tps. The heater control unit 40 determines whether the sensed temperature Tps is equal to or higher than the predetermined temperature Tth or not (A703). If the sensed temperature Tps does not exceed the predetermined temperature Tth, the procedure goes back to Act A701, where the next timing of temperature sensing is waited.

If it is sensed that the sensed temperature Tps is equal to or higher than the predetermined temperature Tth in Act A703, that is, if the fixing belt 31 is about to be overheated, the procedure goes to Act A704, where the side heater 38*b* is turned OFF. Then, the procedure goes to Act A705, where the next timing of temperature sensing is waited. In Act A706, the press roller side temperature sensor 39*b* senses the temperature Tps of the side portion of the press roller 37 as in Act A702.

Then, in Act A707, whether the sensed temperature Tps is lowered to a temperature lower than the predetermined temperature Tth is sensed. As long as the sensed temperature Tps is equal to or higher than the predetermined temperature Tth, the side heater 38*b* is continuously kept in a state of being turned OFF, and in Act A705, the next timing of temperature sensing is waited. On the other hand, when the fact that the sensed temperature Tps is lowered to a temperature lower than the predetermined temperature Tth is sensed, the normal fixing temperature control is restored.

According to this embodiment, if the width of the printing sheet is small and the both side portions in terms of the direction vertical to the direction of rotation of the fixing belt 31 (widthwise direction) are heated, the side heater provided in the press roller is turned OFF. Therefore, overheating of the both side portions is prevented. In addition, since the temperature of the both side portions is lowered gradually, it has an advantage such that the temperature variations are small.

In the embodiment described above, the separated structure having one coil at the center and two side coils on both sides thereof is employed as the induction heat device. However, two or four or more divided coils may be used as the induction heating device in the invention.

In the embodiment descried above, the fixing device using the fixing belt and the press roller is described. However, it is also applicable to employ a fixing roller instead of the fixing belt and heat the surface of the fixing roller directly from the outside by the electromagnetic induction heating. Also, in the embodiment described above, the device configured to bring the press roller into contact with the back surface of the printing sheet is described. However, it is also applicable to use a press belt instead of the press roller.

In the embodiment descried above, the case of using the alternate drive system which drives the center coil and the side coils of the induction heat device is described. However, the simultaneous drive system which passes electric current having the same phase through the both coils may be employed. In the embodiment described above, the device of a (simultaneous drive) system in which electric current of the same phase is passed through the side coils provided on the both sides of the center coil is described. However, these side coils may be driven independently in the invention.

Obviously, many modifications and variations of this invention are possible in the light of the above teachings. It is therefore to be understood that within the scope of the appended claims, this invention may be practiced otherwise than as specification.

What is claimed is:

1. A fixing device configured to fix a toner image on a moving printing medium, comprising:

a fixing heat generator that generates heat by electromagnetic induction;

a fixing medium that rotates and is heated; and a pressing member that presses a back surface of the printing medium which is brought into contact with the fixing medium, the fixing heat generator including a center coil and a pair of side coils provided at a center portion and both side portions thereof in terms of a perpendicular direction with respect to the direction of movement of the printing medium for heating the fixing medium by induction heating, the pressing member including a center heater and a side heater that heat the center portion and the side portions thereof in terms of the perpendicular direction with respect to the direction of movement of the printing medium respectively integrated therein, and further comprising:

a side temperature sensor that senses at least one of the temperatures of the both side portions of the pressing member in terms of a widthwise direction perpendicular to the direction of movement of the printing medium, and a heater control unit that turns OFF the side heater if the temperature that the side temperature sensor senses exceeds a predetermined temperature while the fixing heat generator is operated at a constant power.

2. The device according to claim 1, wherein the pressing member is a press roller.

3. The device according to claim 2, wherein the fixing medium is a fixing belt.

4. The device according to claim 3, wherein the center coil and the pair of side coils are driven alternately.

5. The device according to claim 4, wherein heating by the center coil and the pair of side coils are achieved by changing a duty ratio of the passage of electrical current through these coils.

6. The device according to claim 5, wherein a center temperature sensor and the side temperature sensor are provided on a side of the press roller with respect to the printing medium.

7. The device according to claim 5, wherein the center temperature sensor is provided on the side of the center coil and the side temperature sensor is provided on the side of the press roller and the side coil with respect to the printing medium.

8. A fixing device configured to fix a toner image on a moving printing medium comprising:

a fixing roller that generates heat by electromagnetic induction;

a fixing belt that rotates and is heated while being carried by the fixing roller; and a press roller that comes into press contact with a back surface of the printing medium which is brought into contact with the fixing belt, the fixing roller adjacent to a center coil and a pair of side coils provided at a center portion and both side portions thereof in terms of the widthwise direction perpendicular to the direction of movement of the printing medium for heating the fixing belt by induction heating, the press roller including a center heater and a side heater that heat the center portion and the side portions thereof respectively integrated therein, a center temperature sensor and a side temperature sensor that sense at least one of the temperatures of the center portion and the both side portions of the fixing belt in terms of a widthwise direction perpendicular to the direction of movement of the printing medium; and a heater control unit that turns OFF the side heaters if the temperature that the side temperature sensor senses exceeds a predetermined temperature while the fixing heat generator is maintained at a constant power and turns ON the side heater if the temperature that the side temperature sensor senses falls below the predetermined temperature.

9. The device according to claim 8 wherein the center coil and the pair of side coils are driven alternately.

10. The device according to claim 9, wherein heating by the center coil and the pair of side coils are achieved by changing a duty ratio of the passage of electrical current through these coils.

11. The device according to claim 10, wherein the center temperature sensor and the side temperature sensor are provided on a side of the press roller with respect to the printing medium.

12. The device according to claim 10, wherein the center temperature sensor is provided on the side of the center coil and the side temperature sensor is provided on the side of the press roller and the side coils with respect to the printing medium.

13. A fixing device configured to fix a toner image on a moving printing medium, comprising:

a fixing heat generator that generates heat by electromagnetic induction;

a fixing medium that rotates and is heated;

a pressing member that comes into press contact with a back surface of the printing medium which is brought into contact with the fixing medium, the pressing member including a center heater and a side heater that heat a center portion and both side portions thereof in terms of a perpendicular direction with respect to the direction of movement of the printing medium respectively integrated therein, the fixing heat generator including a center coil and a pair of side coils provided in the widthwise direction perpendicular to the direction of movement of the printing medium for heating the fixing medium by changing a duty ratio of the passage of electrical current through the center portion and the both side portions of the fixing medium, a center temperature sensor and a side temperature sensor that sense the temperature of at least one of the center portion and the side portions of the pressing member and the fixing medium in terms of the widthwise direction perpendicular to the direction of rotation of the fixing medium, a duty ratio control unit that prevents the temperature fall due to the printing medium passing through the inside the side temperature sensor by increasing the duty ratio of the passage of electrical current through the side coils if the temperature difference (Tps−Tpc) reaches or exceeds a predetermined temperature difference as a result of subtracting the temperature Tpc sensed by the center temperature sensor from the temperature Tps sensed by the side temperature sensor, and a heater control unit that turns OFF the side heater if the temperature that the side temperature sensor senses exceeds a predetermined temperature while the fixing heat generator is operated at a constant power and turns ON the side heater if the temperature that the side temperature sensor senses falls below the predetermined temperature.

14. The device according to claim 13, wherein the pressing member is a press roller.

15. The device according to claim 14, wherein the fixing medium is a fixing belt.

16. The device according to claim 15 wherein the center coil and the pair of side coils are driven alternately.

17. The device according to claim 16, wherein the center temperature sensor and the side temperature sensor are provided on a side of the press roller with respect to the printing medium.

18. The device according to claim 17, wherein the center temperature sensor is provided on the side of the center coil and the side temperature sensor is provided on the side of the press roller and the side coils with respect to the printing medium.

19. The device according to claim 18, wherein the predetermined temperature difference is about 10° C.

* * * * *